US006413176B1

(12) United States Patent
Martinez

(10) Patent No.: US 6,413,176 B1
(45) Date of Patent: Jul. 2, 2002

(54) BAT SWING AID

(76) Inventor: Tommy Martinez, 6031 SW. 183rd Way, Ft. Lauderdale, FL (US) 33331-1637

( * ) Notice: Subject to any disclaimer, the term of this patent is extended or adjusted under 35 U.S.C. 154(b) by 0 days.

(21) Appl. No.: 09/635,455

(22) Filed: Aug. 11, 2000

(51) Int. Cl.[7] ..... A63B 69/00

(52) U.S. Cl. ..... 473/458; 473/464; 473/205; 473/212; 2/160; 2/162; 2/163

(58) Field of Search ..... 473/201, 205, 473/213, 229, 430, 458, 462, 464, 409, 212, 214, 453; 128/878, DIG. 15; 2/161.1–161.5, 162, 170, 16, 59, 20, 160, 910, 917; 434/252, 251

(56) References Cited

U.S. PATENT DOCUMENTS

| | | | | | |
|---|---|---|---|---|---|
| 1,681,389 | A | * | 8/1928 | Blake | 473/205 |
| 2,474,030 | A | * | 6/1949 | Braswell | 473/205 |
| 3,105,972 | A | * | 10/1963 | Christopher | 473/205 |
| 3,249,359 | A | * | 5/1966 | Goldberger | 473/205 |
| 3,957,267 | A | * | 5/1976 | Vitalo | 473/205 |
| 4,273,336 | A | | 6/1981 | Larkey | |
| 4,700,405 | A | * | 10/1987 | Sternberg | 2/161 |
| 4,752,075 | A | * | 6/1988 | Bencriscutto | 473/205 |
| 4,890,841 | A | * | 1/1990 | Brooks | 473/212 |
| 4,892,317 | A | * | 1/1990 | Corder, Jr. | 473/212 |
| 4,960,280 | A | * | 10/1990 | Corder, Jr. | 473/212 |
| 5,005,833 | A | * | 4/1991 | Groveman et al. | 473/464 |
| 5,154,416 | A | | 10/1992 | Smull | |
| D353,172 | S | * | 12/1994 | Gaut | D21/191 |
| 5,557,805 | A | * | 9/1996 | Emerson | 2/158 |
| 5,711,747 | A | * | 1/1998 | Steinback | 482/124 |
| 5,938,548 | A | * | 8/1999 | Upshaw | 473/453 |
| 6,006,358 | A | * | 12/1999 | Keating | 473/464 |
| 6,231,464 | B1 | * | 5/2001 | Curtis | 473/458 |

* cited by examiner

*Primary Examiner*—Paul T. Sewell
*Assistant Examiner*—Mitra Aryanpour

(57) ABSTRACT

A wrist worn bat swing aid (10) includes a closed band (12) constructed to fit around a wrist of a leading arm, the closed band having a first fastener portion (13) of a detachable fastener. The aid (10) further includes an open band (14) coupled to the closed band for placement around a wrist of a guide arm, wherein the closed band has a second fastener portion (18) of the detachable fastener for mating with the first fastener portion. Optionally, a second closed band (20) is coupled to the first closed band, wherein the second closed band is formed to fit around a finger of the leading arm.

10 Claims, 1 Drawing Sheet

10

BAT SWING AID

FIELD OF THE INVENTION

The present invention is directed to a sports equipment guide, and more particularly to a wrist-worn aid for maintaining an optimum batting stance, swing, and follow through.

BACKGROUND OF THE INVENTION

Having a proper bat swing allows a batter to attain maximum bat speed at the point of contact with a baseball or softball. Forming the "A" frame with both arms before swinging a bat is also critical for most batters in attaining the maximum bat speed. Keeping the wrists together as the batter swings through a hitting zone or a strike zone within the hitting and following through after the strike zone again assures that most of the power is applied at the point of contact.

Many inexperienced batters fail to maintain an "A" frame when preparing to hit a ball. Either they over-extend their leading arm or over-extend their guide arm. In the case of a right handed batter, the leading arm would be their left arm and the guiding arm would be their right arm. In many instances, the batter is unaware about their over-extension out of the "A" frame position. Furthermore, many inexperienced batters fail to maintain their wrists together as they swing through a strike zone and are likewise unaware of this improper positioning. Thus, a need exists for a batting aid that would keep batters aware of their "A" frame starting position and further aware of their wrist position as they swing through a hitting zone or strike zone.

DETAILED DESCRIPTION

Figure 1:
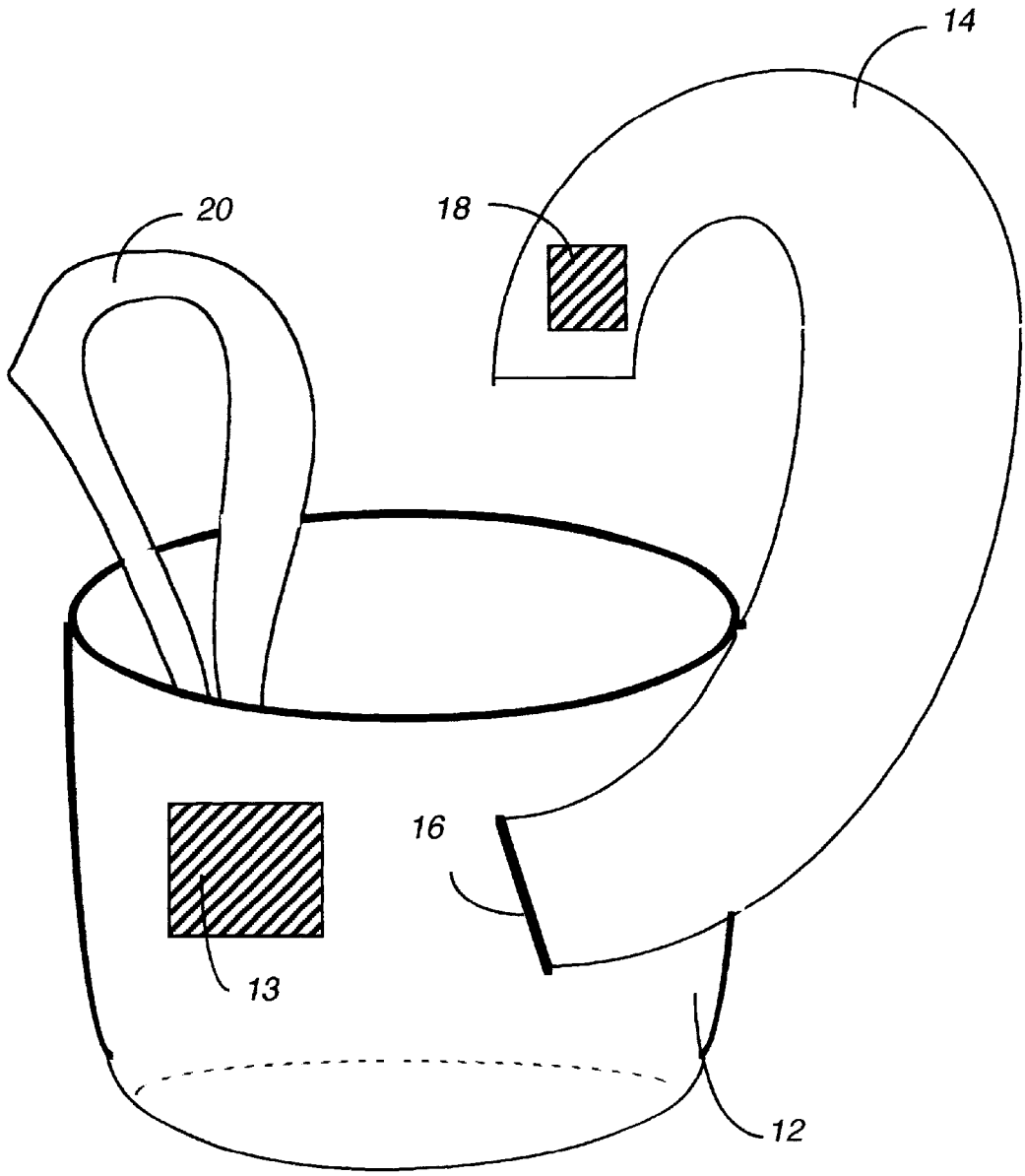
FIG. 1 is an illustration showing the bat switch aid in accordance with the present invention.

Referring to FIG. 1, a wrist worn bat swing aid 10 is shown. The bat swing aid 10 is preferably arranged and constructed to have a closed band 12 that fits around a wrist of a leading arm, the closed band 12 having a first fastener portion 13. The bat swing aid 10 also comprises an open band 14 coupled to the closed band 12 for placement around a wrist of a guide arm, wherein the open band 14 has a second fastener portion 18 for mating with the first fastener portion 13 such that the first fastener portion 13 and the second fastener portion 18 form a detachable fastener. Preferably, the detachable fastener portions are made from hook and loop fasteners such as Velcro. Other type of fasteners could be used such as snap fit connectors, but hook and loop fasteners are preferable. Preferably the open band 14 is coupled to the closed band 12 using stitches 16 and angled as shown in a position between parallel and perpendicular to the closed band 12.

Operationally, the detachable fastener (13 and 18) selectively detaches when a batter extends either the leading arm or the guide arm beyond an optimum A frame position or when a batter fails to maintain the wrist of the leading arm and the wrist of the guide arm together through a swing.

Optionally, the wrist worn bat swing aid 10 further comprises a second closed band 20 coupled to the first closed band 12, wherein the second closed band 20 is formed to fit around a finger of the leading arm. Preferably, the second closed band 20 is made of elastic material.

Using the bat swing aid 10, a method of maintaining a proper initial batting position and wrist position through a batting swing is facilitated. First, one would harness the closed band 12 around the wrist of a leading arm. Next, an open band or a detachable band 14 which is coupled to the closed band 12 is attached around the wrist of a guide arm. The detachable band 14 selectively detaches from the wrist of the guide arm when a user extends their arms beyond a proper initial batting position (such as an "A" frame position) or selectively detaches from the wrist of the guide arm when the user fails to maintain their wrists together when swinging through a hitting zone or a strike zone within the hitting zone. The method may further comprise the step of harnessing a second closed band 20 around a finger of the leading arm, wherein the second closed band 20 is coupled to the first closed band. Ideally, the second closed band 20 is comprised of a stretchable material so that the wrist of the user's leading arm is biased to stay together with the wrist of the user's guide arm.

The above description is intended by way of example only and is not intended to limit the present invention in any way except as set forth in the following claims.

What is claimed is:

1. A wrist worn bat swing aid, comprising:

a permanently closed band constructed to fit around a wrist of a leading arm, the closed band having a first fastener portion of a detachable fastener;

an open band coupled to the closed band for placement around a wrist of a guide arm, wherein the open band has a second fastener portion of the detachable fastener for mating with the first fastener portion and wherein the second fastener portion selectively detaches from the first fastener portion when a batter extends either the leading arm or the guide arm beyond an optimum A frame position or when the batter fails to maintain the wrist of the leading arm and the wrist of the guide arm together through a swing; and a second closed band coupled to the first closed band, wherein the second closed band is formed to fit around a finger of the leading arm.

2. The wrist worn bat swing aid of claim 1, wherein the detachable fastener selectively detaches when a batter extends either the leading arm or the guide arm beyond an optimum A frame position.

3. The wrist worn bat swing aid of claim 1, wherein the detachable fastener selectively detaches when a batter fails to maintain the wrist of the leading arm and the wrist of the guide arm together through a swing.

4. The wrist worn bat swing aid of claim 1, wherein the first fastener portion and the second fastener portion are made from mating portions of hook and loop fasteners.

5. The wrist worn bat swing aid of claim 1, wherein the second closed band is made of elastic material.

6. The wrist worn bat swing aid of claim 1, wherein the open band is coupled to the closed band using stitches and angled in a position between parallel and perpendicular to the closed band.

7. A method of maintaining a proper initial batting position and wrist position through a batting swing, comprising the steps of:

harnessing a closed band around the wrist of a leading arm;

attaching a detachable band which is coupled to the closed band around the wrist of a guide arm;

selectively detaching the detachable band from the wrist of the guide arm when a user extends their arms beyond a proper initial batting position;

selectively detaching the detachable band from the wrist of the guide arm when the user fails to maintain their wrists together when swinging through a hitting zone.

8. The method of claim 7, wherein the method further comprises the step of harnessing a second closed band around a finger of the leading arm, wherein the second closed band is coupled to the first closed band.

9. The method of claim 8, wherein the second closed band is comprised of a stretchable material so that the wrist of the user's leading arm is biased to stay together with the wrist of the user's guide arm.

10. The method of claim 7, wherein the step of selectively detaching the detachable band from the wrist of the guide arm occurs the user fails to maintain their wrists together when swinging through a strike zone within the hitting zone.

* * * * *